US009586748B2

(12) United States Patent
Le

(10) Patent No.: US 9,586,748 B2
(45) Date of Patent: Mar. 7, 2017

(54) CARRIER CARD FOR PEEL-OPEN BLISTERS

(71) Applicant: MeadWestvaco Corporation, Richmond, VA (US)

(72) Inventor: Thanhhung N. Le, Henrico, VA (US)

(73) Assignee: WestRock MWV, LLC, Norcross, GA (US)

( * ) Notice: Subject to any disclaimer, the term of this patent is extended or adjusted under 35 U.S.C. 154(b) by 327 days.

(21) Appl. No.: 14/211,721

(22) Filed: Mar. 14, 2014

(65) Prior Publication Data

US 2014/0262906 A1 Sep. 18, 2014

Related U.S. Application Data

(60) Provisional application No. 61/793,650, filed on Mar. 15, 2013.

(51) Int. Cl.
*B65D 83/04* (2006.01)
*B65D 5/38* (2006.01)

(52) U.S. Cl.
CPC ..... *B65D 83/0463* (2013.01); *B65D 5/38* (2013.01)

(58) Field of Classification Search
CPC ..... B65D 83/0463; B65D 5/38; B65D 75/36; B65D 75/327
USPC ..... 206/1.5, 528, 530–532, 534, 538, 539; 229/125.125
See application file for complete search history.

(56) References Cited

U.S. PATENT DOCUMENTS

| | | | | |
|---|---|---|---|---|
| 4,817,819 | A | 4/1989 | Kelly | |
| 5,878,887 | A | 3/1999 | Parker et al. | |
| 5,927,500 | A | 7/1999 | Godfrey et al. | |
| 6,047,829 | A * | 4/2000 | Johnstone | B65D 5/38 206/1.5 |
| 6,230,893 | B1 * | 5/2001 | Karow | B65D 5/38 206/1.5 |
| 6,412,636 | B1 * | 7/2002 | Jones | B65D 5/38 206/532 |
| 6,491,211 | B1 * | 12/2002 | Evans | B65D 5/38 206/532 |
| 6,874,636 | B2 * | 4/2005 | Paliotta | B65D 75/327 206/1.5 |
| 7,658,287 | B2 | 2/2010 | Hession | |
| 8,499,936 | B2 * | 8/2013 | Albrecht | B65D 83/0463 206/528 |
| 9,174,780 | B2 * | 11/2015 | Gelardi | B65D 83/0463 |
| 2005/0023180 | A1 * | 2/2005 | Intini | B65D 75/36 206/532 |
| 2007/0054525 | A1 | 3/2007 | Jones et al. | |
| 2007/0068843 | A1 | 3/2007 | Hession | |

(Continued)

FOREIGN PATENT DOCUMENTS

| | | |
|---|---|---|
| GB | 2216102 | 10/1989 |
| WO | WO2005/068304 | 7/2005 |
| WO | WO2010/011704 | 1/2010 |

OTHER PUBLICATIONS

Combined Search and Examination Report for UK Application No. GB1404604.9 dated Aug. 1, 2014.

*Primary Examiner* — Luan K Bui
(74) *Attorney, Agent, or Firm* — WestRock Intellectual Property Group

(57) ABSTRACT

A package structure is disclosed for carrying blister cards of the peel-open variety, and for securing the blister cards within an outer sleeve enclosure.

20 Claims, 17 Drawing Sheets

(56) References Cited

U.S. PATENT DOCUMENTS

| | | | | |
|---|---|---|---|---|
| 2008/0017542 | A1 | 1/2008 | Le et al. | |
| 2009/0301924 | A1 * | 12/2009 | Rondeau | B65D 83/0463 206/531 |

* cited by examiner

CARRIER CARD FOR PEEL-OPEN BLISTERS

CROSS REFERENCE TO RELATED APPLICATIONS

This application claims the benefit of US Provisional Patent Application No. 61/793,650 filed Mar. 15, 2013, which is incorporated herein by reference in its entirety.

BACKGROUND OF THE INVENTION

The present application is directed to blister packages and, more particularly, to carrier cards for holding peel-open blisters.

Medications are often packaged in blister packages typically include a number of cavities or blisters formed in a sheet of polymer or plastic material. The polymer may be transparent and may include or be coated with materials that provide desired properties such as resistance to moisture or oxygen or other substances that might adversely affect the medications. As is typical with polymers and plastics, the sheet polymer material may be tough and relatively rigid while still being somewhat flexible.

The individual blisters typically may protrude from one surface of the polymer sheet, with the other surface of the sheet being flat or relatively flat, aside from the depressions making up the cavities. After the cavities are loaded with medications, the 'flat' surface of the sheet may be closed by a sealing film, such as aluminum foil or a combination of foil and plastic, or other suitable material. While the polymer film and blisters may be transparent, in order to better view the contents, the sealing film may typically by opaque and may contain printed information regarding the medication or its use, or instructions how to remove the blister contents.

Certain types of packages are known in which to contain blister cards. Such packages are often in the form of sleeves (e.g. boxes with an open end). Sleeves or boxes surrounding the blister cards offer protection from wear or from light (which may degrade certain medications), provide advertising or instructional space not otherwise sufficiently available on the blister card itself, and can provide resistance against unintended users opening the blisters (e.g., "child resistance" or "CR").

When blister cards are packaged within a sleeve they are often attached to a carrier material. The carrier material may provide additional structure to interact with the sleeve and provide the desired child resistance features. For example, the carrier may be sheet material of sufficient thickness and appropriate material to provide sufficient strength and rigidity. Typical carrier materials may include plastic, paperboard, paper, and other materials.

The blister card may be positioned between a first layer of carrier material on one surface (e.g. the surface with the protruding blisters) and a second layer or backing layer of carrier material on the other surface (e.g. the surface with the sealing film). The first layer may have openings therein to receive the protruding blisters. The second layer may have perforations or cutouts proximate to each blister. The first and second layers maybe provided as two pieces of similar or dissimilar material, or they may be provided as one piece of carrier material including a fold line so that when the carrier material is folded along that line and brought together, two layers are formed, and the blister card may be held or "sandwiched" between the first and second layers of carrier material. The layers and the blister card may be attached together, for example by adhesive or heat sealing.

To remove contents from certain types of blister, pressure may be applied to the blister until it collapses and pushes the blister contents through the sealing film. On the other hand, for "peel-open" blisters, the contents are typically removed by first peeling away the sealing film, then removing the contents from the blister. However, for peel-open blisters, it is desirable that the sealing film be accessible, at least in the area where the peeling action is intended to be initiated. Thus a layer of carrier material covering the sealing film is not desired.

SUMMARY

In one aspect a packaging structure for being received into a sleeve is disclosed, which includes a blister card including a polymeric sheet having first and second opposing surfaces, a plurality of cavities formed in the polymeric sheet as depressions in the first surface and extending as protrusions from the second surface, and a lidding sheet substantially covering the first surface and sealing the plurality of cavities; a carrier card including a carrier sheet having at least one aperture therein to receive the plurality of blisters, and a retention device attached to or formed in the carrier sheet, wherein the blister card is attached to the carrier card with the blister card second surface in facing contact with the carrier card and the blister lidding sheet is uncovered.

Other aspects of the disclosed packaging structures will become apparent from the following description and the accompanying drawings.

BRIEF DESCRIPTION OF THE DRAWINGS

The attached

FIG. 1 shows a top perspective view of a carrier card;

FIG. 2 shows an partial, cross section, exploded view of the structure of FIG. 1;

FIG. 3 shows a top perspective view of another carrier card;

FIG. 4 shows an partial, cross section, exploded view of the structure of FIG. 3;

FIG. 5 shows a top perspective view of another carrier card, for holding peel-open blisters;

FIG. 6 shows an partial, cross section, exploded view of the structure of FIG. 5;

FIG. 7-12 shows exemplary methods of assembling the carrier card of FIGS. 5-6;

FIG. 13 shows one example of a retaining feature for the carrier cards of FIGS. 5-12;

FIGS. 14-16 shows additional examples of retaining features for the carrier cards of FIGS. 5-12;

FIG. 17 is a perspective view from above of an open package comprising an outer sleeve and a blister/carrier strip;

FIG. 18 is a perspective view from above of another blister card and carrier card to receive the blister card, wherein a locking tail flap of the carrier card is folded relative to a main portion of the carrier card;

FIG. 19 is a perspective view from above of the blister card and carrier card of FIG. 18 having been joined together;

FIG. 20 is a plan view of a blank for forming an outer sleeve, which may be used in conjunction with the combined blister- and carrier cards of the present disclosure;

FIG. 21 is a front view of the outer sleeve of FIG. 20, wherein cross-sectional line 22-22 has been marked thereon; and FIG. 22 is a cross-sectional view taken along the line 22-22 shown in FIG. 21.

DETAILED DESCRIPTION

Figure 1:
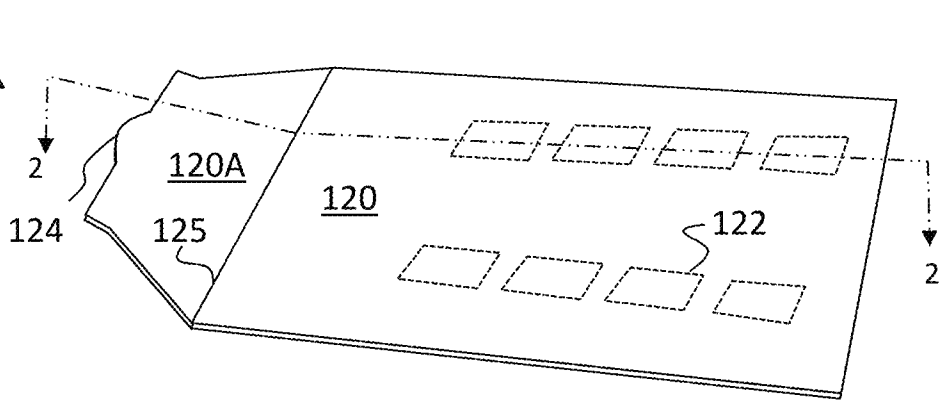
FIGS. 1-22 show assemblies of carrier and blister cards(s) from various vantage points.

As various embodiments of the blister carrier card are described, reference will be made to the attached Figures. Certain parts are denoted by reference numerals. Where there is more than one of the same feature, sometimes only one will be denoted by a reference numeral. If structures have a common feature, it may only be described one time, and may in other drawings be designated with a different 'hundreds' prefix, for example blister cards designated 130, 230, 330, etc.

Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the cards described here are made from one blank (that is, the cut sheet parts from which the card is made by folding and other steps). However, it should be understood that carrier cards may be provided instead as more than one part.

Figure 2:
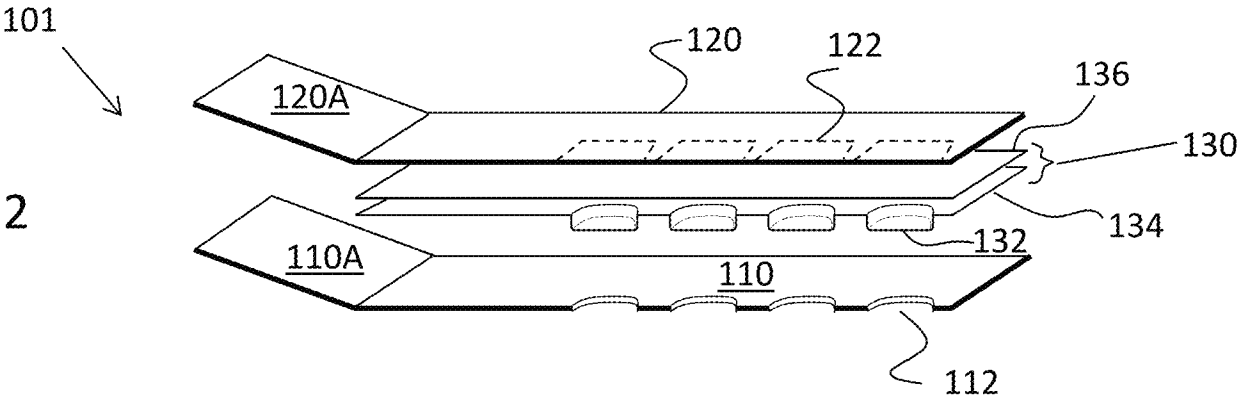

FIGS. 1 and 2 show a top perspective view 100 and a partial cutaway, exploded view 101 of a structure including a blister card 130 (including blister sheet 134 and seal film 136) sandwiched between first carrier card 110 and second carrier card 120. In this structure, the blisters 132 face "downward" and are received in openings 112 in first carrier card 110. Second carrier card 120 covers the sealing film 138. Lines of weakness 122 may be provided in second carrier card 120, defining potential openings through which the contents of blisters 132 may be pushed out. At one end of the structure, flaps 110A and 120A may be hingedly attached to at least one of first carrier card 110 and second carrier card 120, respectively. The flap or flaps may form part of a retaining and or locking feature.

Figure 3:
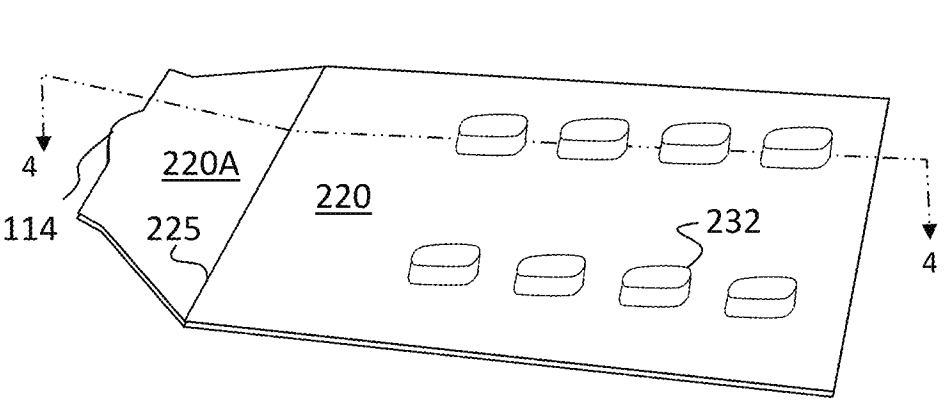
Figure 4:
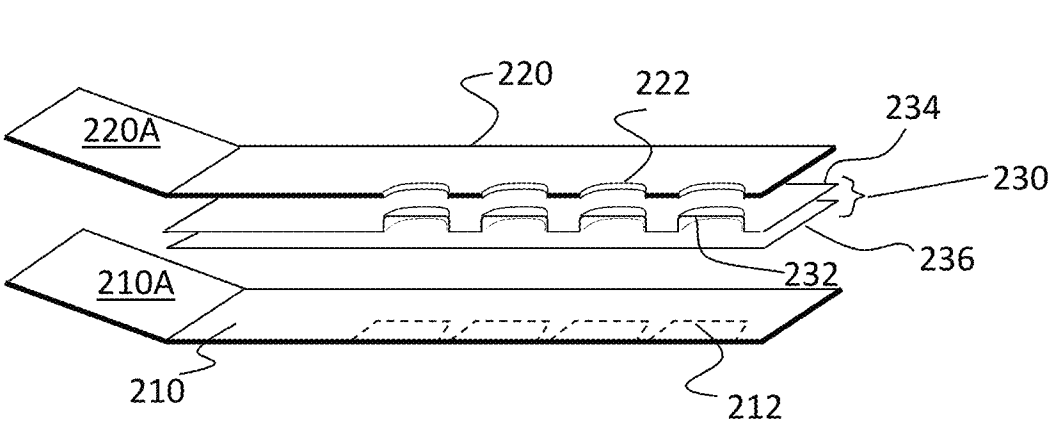

FIGS. 3 and 4 show a top perspective view 200 and a partial cutaway, exploded view 201 of a structure including a blister card 230 (including blister sheet 234 and seal film 236) sandwiched between first carrier card 210 and second carrier card 220. In this structure, the blisters 232 face "upward" and are received in openings 222 in second carrier card 220. First carrier card 210 covers the sealing film 238. Lines of weakness 212 may be provided in first carrier card 210, defining potential openings through which the contents of blisters 232 may be pushed out. At one end of the structure, flaps 210A and 220A may be hingedly attached to at least one of first carrier card 210 and second carrier card 220, respectively. The flap or flaps may form part of a retaining and or locking feature.

Figure 5:
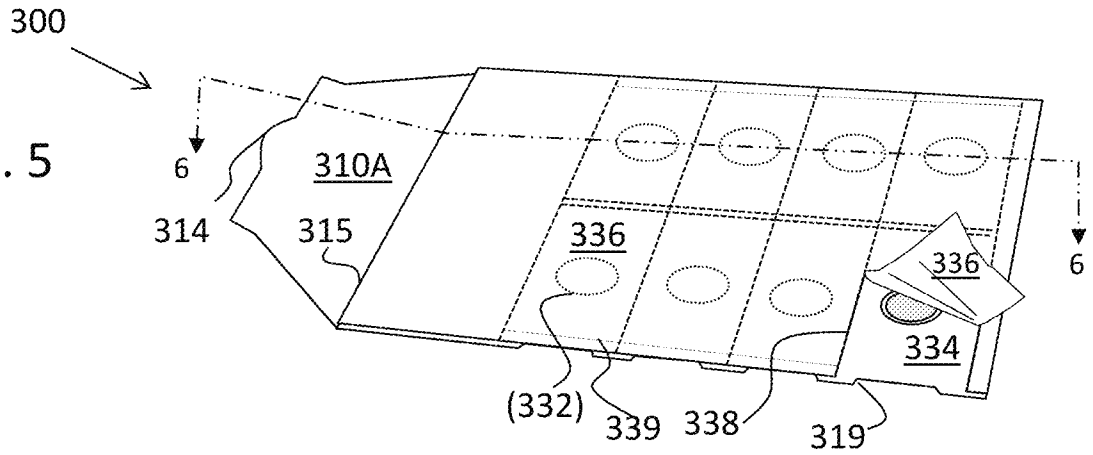
Figure 6:
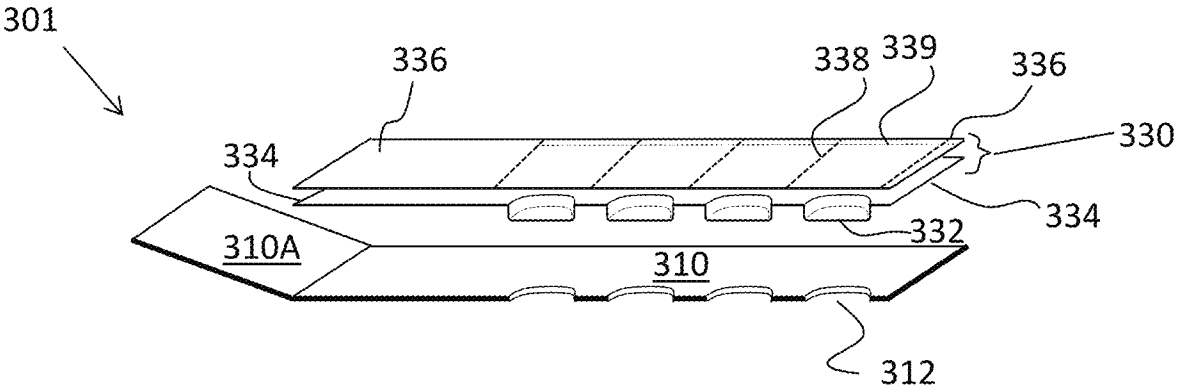

FIGS. 5 and 6 show a top perspective view 300 and a partial cutaway, exploded view 301 of a structure including a peel-open blister card 330 (including blister sheet 334 and seal film 336) attached to carrier card 310. In this structure, the blisters 332 face "downward" and are received in openings 312 in carrier card 310. Sealing film 338 is exposed on the upper surface of the structure. An exposed sealing film 338 is advantageous to provide access to certain areas of the blister sheet and/or seal film where a peeling may easily be initiated. Lines of weakness 338 may be provided in seal film 336, to facilitate peeling open the blisters 332. Although much of the blister sheet 334 and seal film 336 may be adhered together, certain areas such as edges 339 may be left unadhered, in order to more easily start the peeling. Alternately or in addition, small cutaway areas 319 may be provided in carrier card 319 to help expose the sealing film 336 at these areas to more easily grasp the sealing film and initiate peeling. At an end of the structure, flap 310A may be hingedly attached to carrier card 310. The flap may form part of a retaining and or locking feature.

Figure 7:
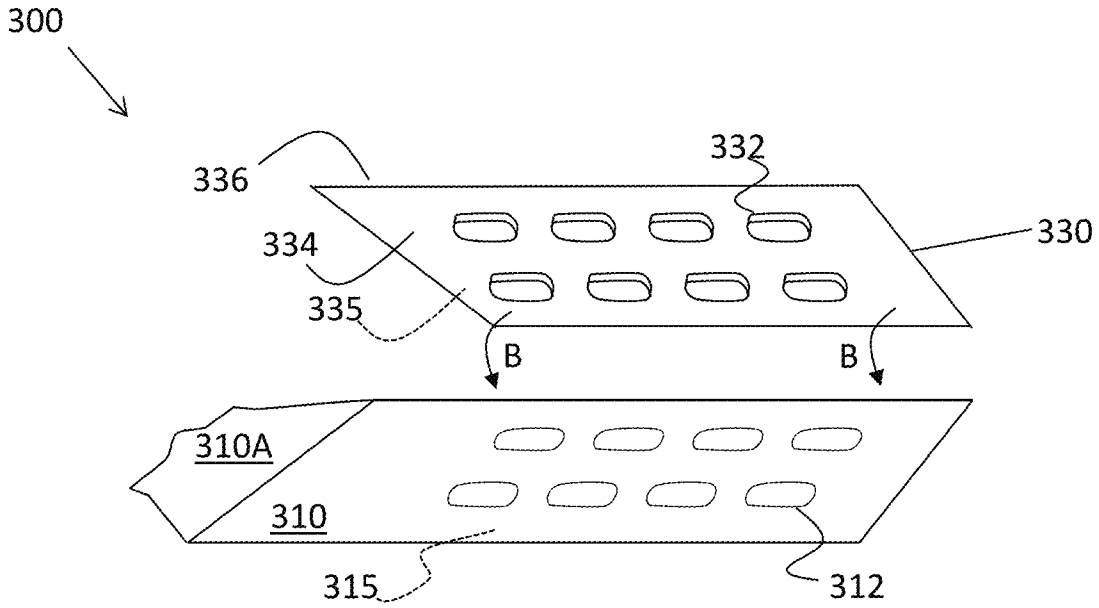

FIG. 7 shows a possible assembly method for the structure shown in FIG. 5-6. The carrier card 310 (e.g. on its surface facing blister card 330) may have a coating 335, and/or the blister card 330 (e.g. on its surface facing carrier card 310) may a coating 315, such coating for example being a heat-sealable coating, in order to seal together the carrier card 310 and the blister card 330. The blister card 330 may be positioned on carrier card 310 (e.g. as shown by arrows B), and the cards heat sealed together by any suitable method, such as thermal heat sealing, ultrasonic heat sealing, RF sealing, and the like.

Figure 8:
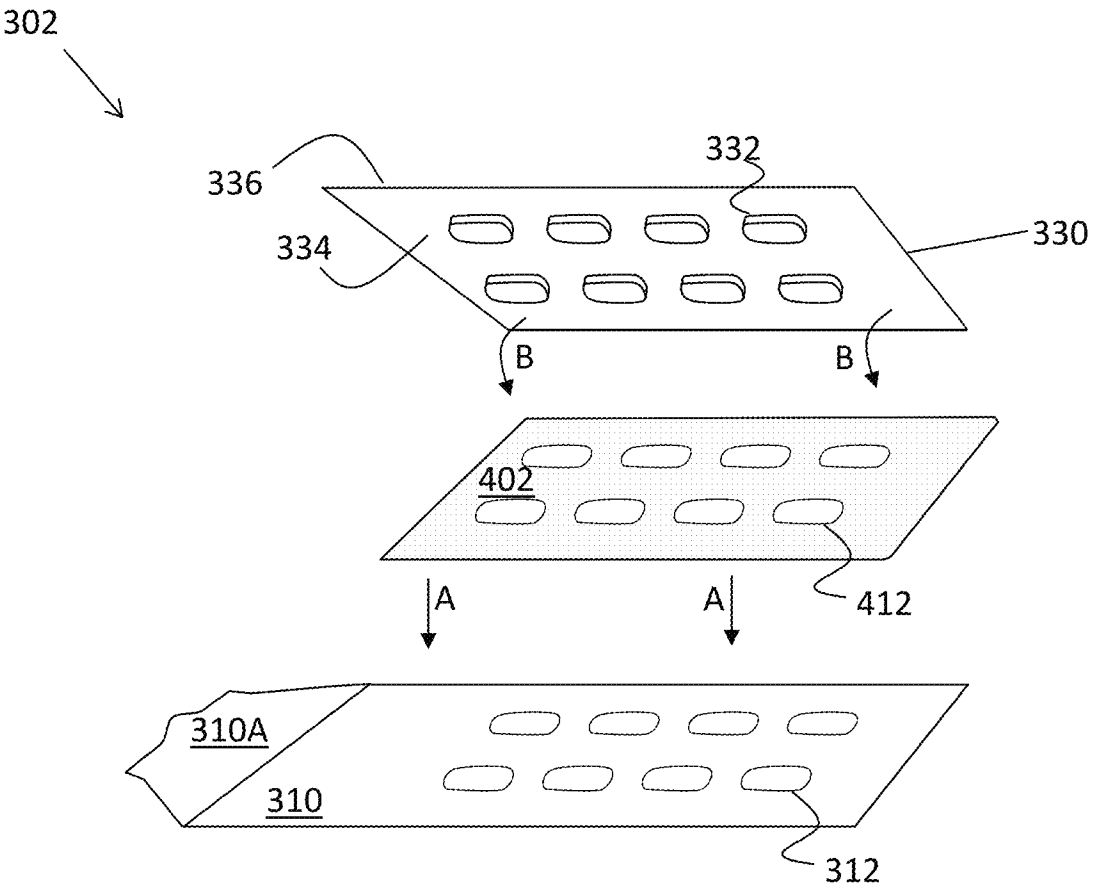

FIG. 8 shows another possible assembly method for the structure shown in FIG. 5-6. An adhesive film 402 (such as a double-faced adhesive material) may be placed between the upper surface of carrier card 310 and the lower surface of blister card 330. The adhesive film 402 may thus be placed upon the upper surface of carrier card 301 (as shown by arrows A), or upon the lower surface of blister card 330 (e.g. on its surface facing carrier card 310). The blister card 330 may then be lowered onto the adhesive film 402 (as shown by arrows B) in order to seal together the carrier card 310 and the blister card 330. Openings 412 may be provided in adhesive film 402, for each blister, or for groups of blisters, through which blisters 332 may pass without being fouled by the adhesive material.

Figure 9:
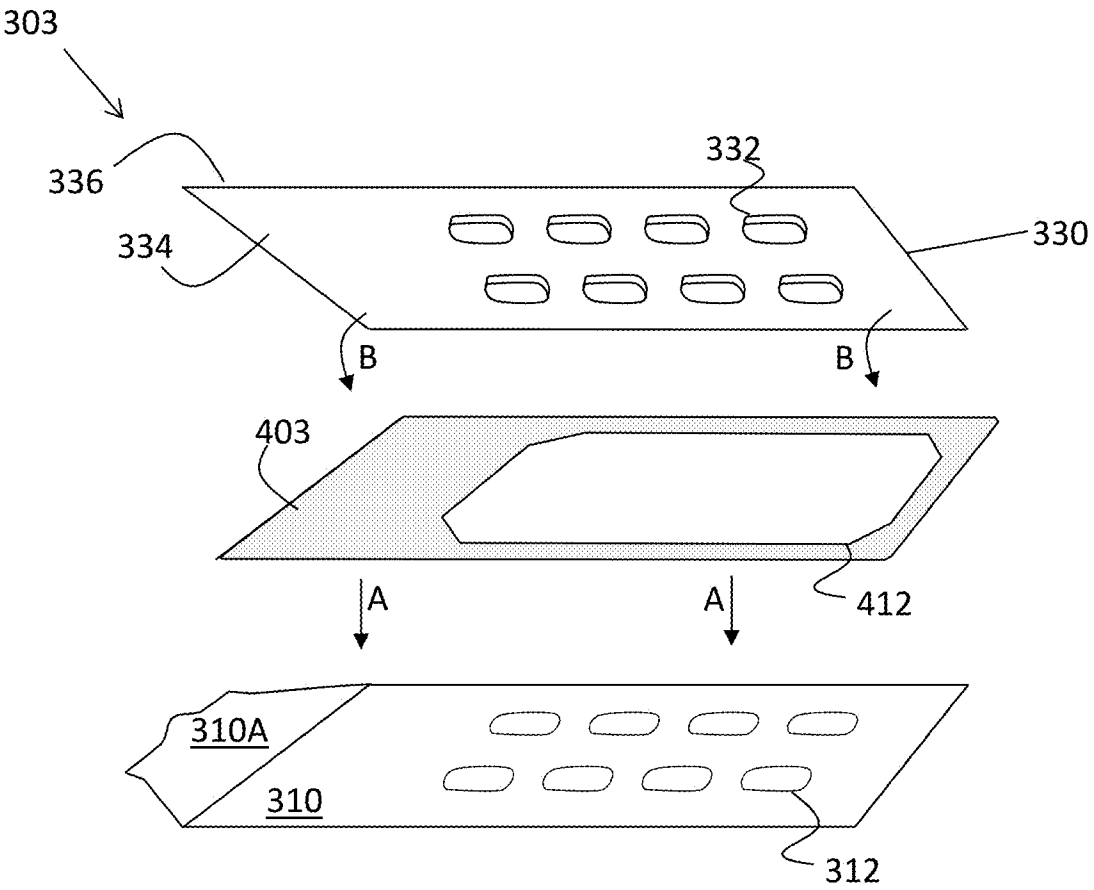
Figure 10:
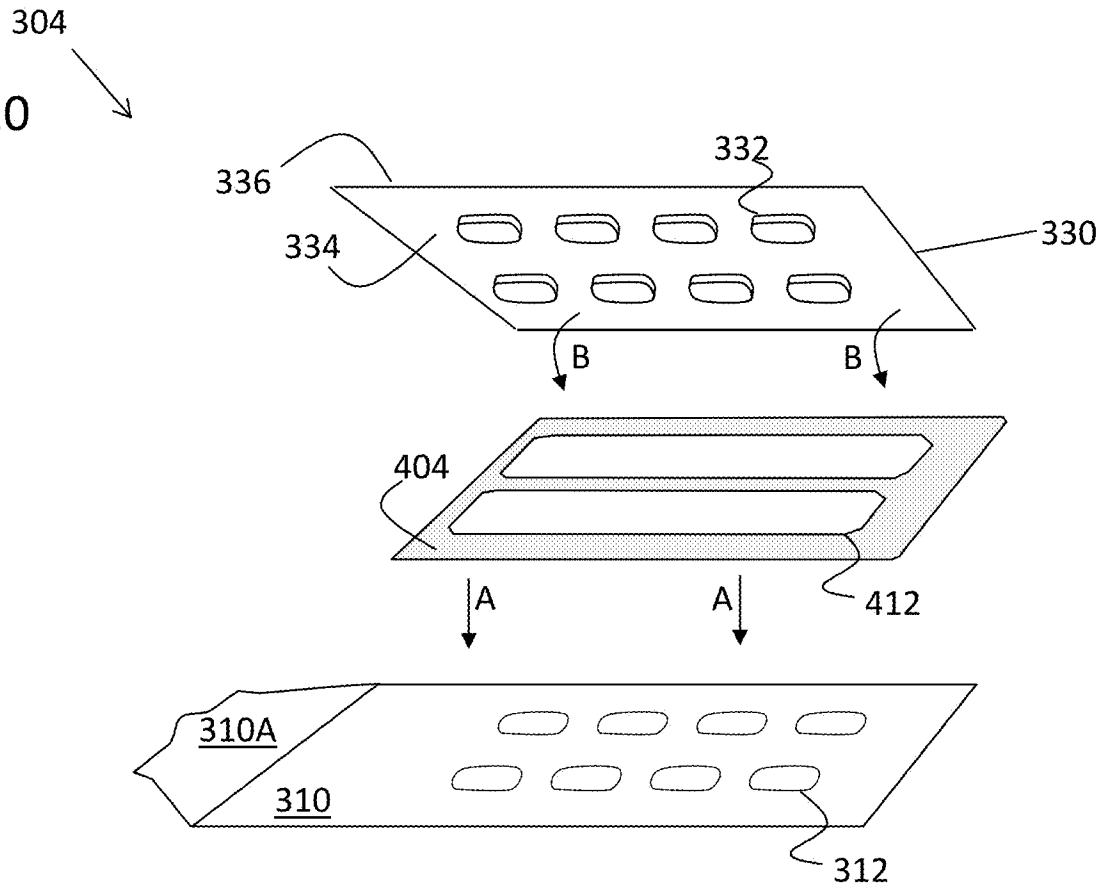

FIG. 9 shows another possible assembly method for the structure shown in FIG. 5-6. As described with respect to FIG. 8, an adhesive film 403 (such as a double-faced adhesive material) may again be placed between the upper surface of carrier card 310 and the lower surface of blister card 330. One or more large openings 412 may be provided in adhesive film 403, through which blisters 332 may pass without being fouled by the adhesive material. The adhesive film 403 may thus be provided to seal the perimeter of the cards 310, 330 as shown, or in any other suitable pattern. For example, FIG. 10 shows an adhesive film 404 which seals the perimeter of cards 310, 330, and also a center strip or area between the two rows of blisters 332.

Figure 11:
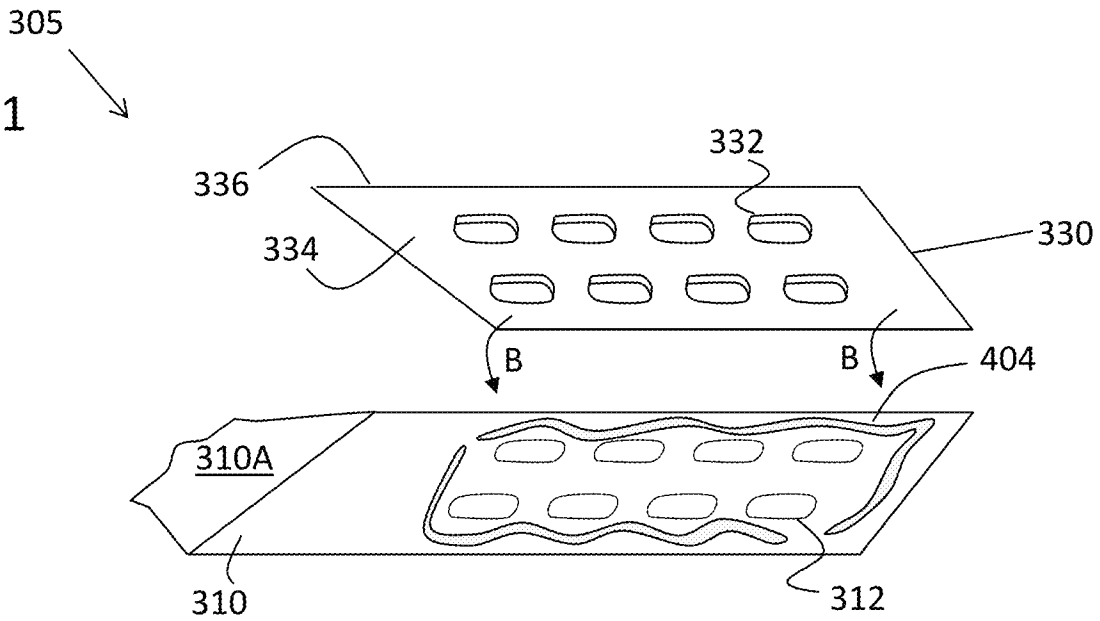

FIG. 11 shows another possible assembly method for the structure shown in FIG. 5-6. An adhesive material 404 such as a liquid or hot-melt glue may be provided in any suitable pattern between the upper surface of carrier card 310 and the lower surface of blister card 330, in order to seal together carrier card 310 and blister card 330.

Another method to provide adhesive is to press-apply an adhesive material to the 'upper' surface of carrier card 301 (that is, the surface to be in contact with the blister card 330). Such a press-applied adhesive may be applied either over the entire surface of the carrier card material, or it may be applied in a pattern that does not cover the entire surface of the carrier card material.

Figure 12:
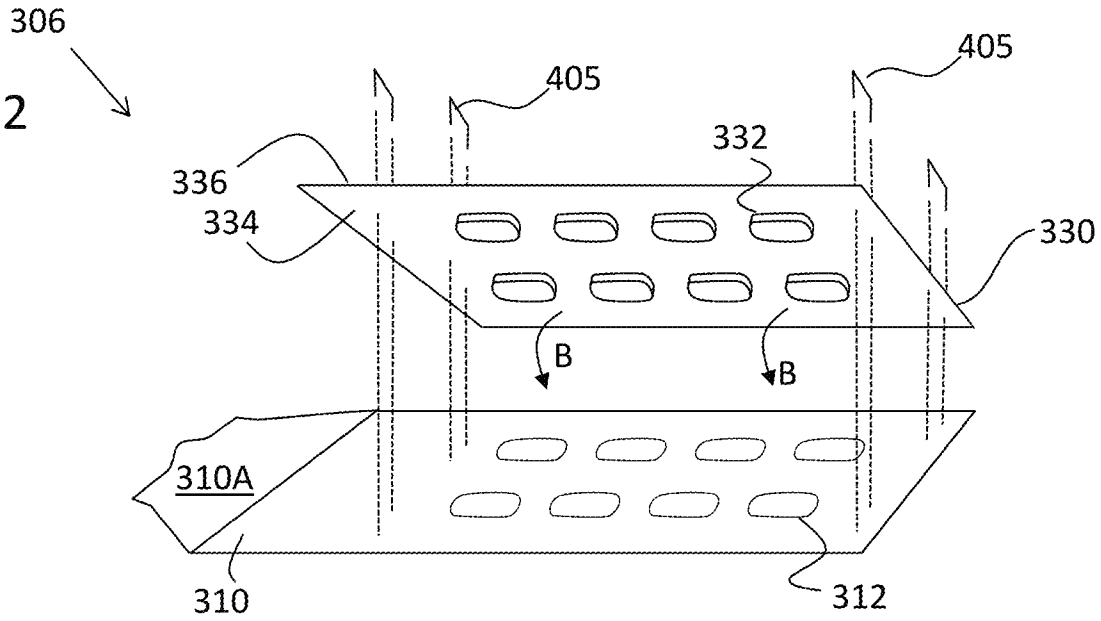

FIG. 12 shows another possible assembly method for the structure shown in FIG. 5-6. Mechanical fasteners such as staples 405 may be used to fasten together carrier card 310 and blister card 330. Stitching, grommets, crimping, and any other mechanical fastening method may also be used.

Figure 13:
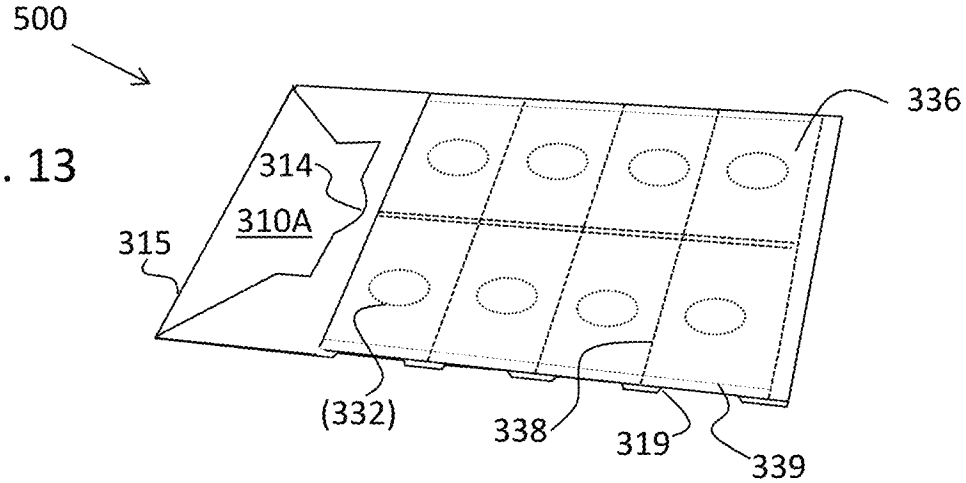

FIG. 13 shows an example retaining feature by which the combined structure 500 (carrier card 310 and blister card 330) may be retained within a sleeve (or other enclosure such as a carton). Here, flap 310A may be folded back with respect to carrier card 310, along fold line 315, in order to provide a retention feature. The retention feature may have one or more nodes 314 which may interact with the sleeve to hold or release the structure 500 within the sleeve.

Figure 14:
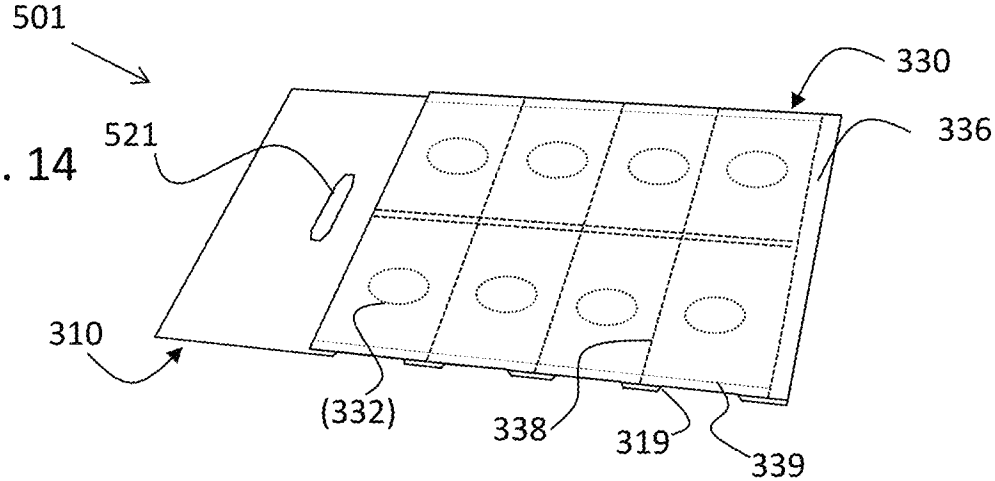

FIG. 14 shows another example retaining feature by which the combined structure 501 (carrier card 310 and blister card 330) may be retained within a sleeve or carton. Here, one or more apertures 521 may be provided in at least one of carrier card 310 and/or blister card 330, in order to provide a retention feature which may interact with the enclosure to hold or release the structure 500 within its sleeve. Any number of apertures 521 may be provided, with any shape or shapes, and any location, suitable to interact with the sleeve.

Figure 15:
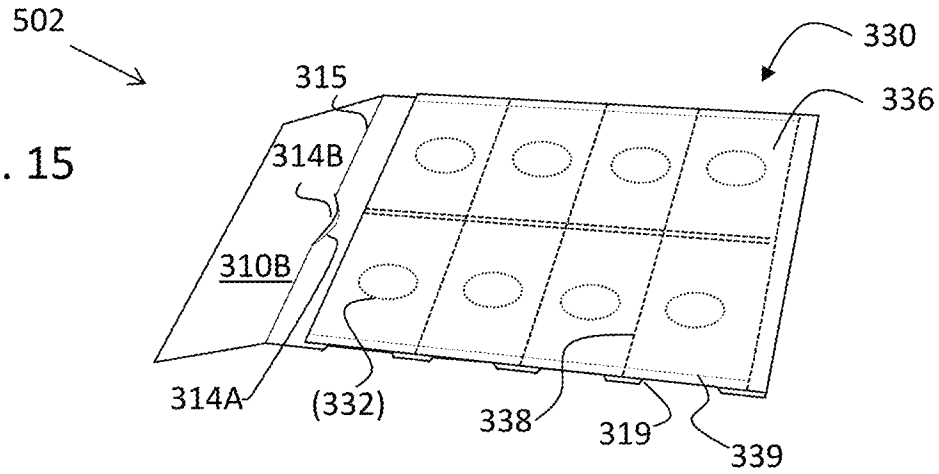

FIG. 15 shows another example retaining feature by which the combined structure 502 (carrier card 310 and blister card 330) may be retained within a sleeve or carton. An arc-shaped cut 314A may be formed along fold line 315 between carrier card 310 and carrier card extension 310B. If any scoring or other weakening of the material is provided to help define the fold line 315, such weakening optionally does not extend through the arc-shaped lock/retention node 314B defined by the cut 314A. The arc-shaped cut may be positioned so that when card carrier extension 310B is folded back and down below the plane of carrier card 310 (approximately as shown), the lock/retention node 314B will extend upward above the plane of carrier card 310. This arc-shaped area 314B may be used as a retention feature which may interact with a sleeve to hold or release structure 502 within the sleeve. Shapes other than an arc may be used for the lock/retention node 314B. More than one lock/retention node may be provided. The lock/retention feature may serve as a lock feature (to keep the card entirely inside the sleeve), a retention feature (to keep the card from being completely removed from the sleeve), or as a lock feature and a retention feature.

Figure 16:
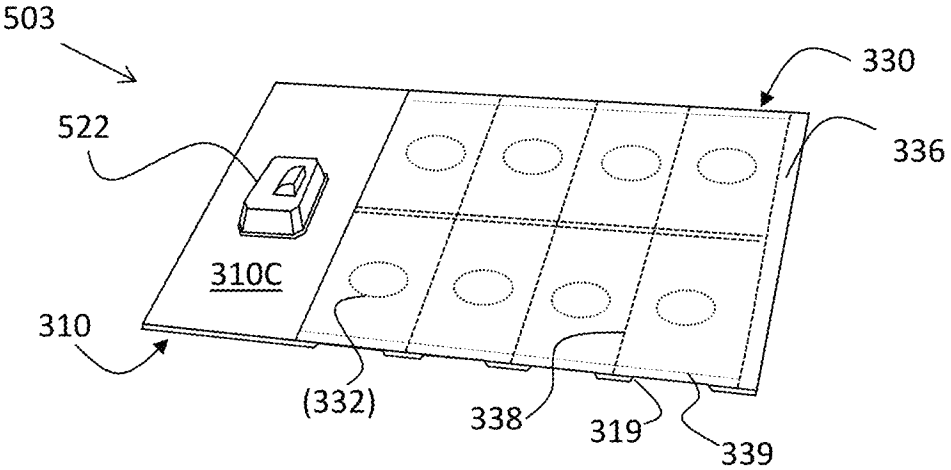

FIG. 16 shows another example retaining feature by which the combined structure 503 (carrier card 310 and blister card 330) may be retained within a sleeve or carton. A lock/retention feature 522 may be form near an inner end of carrier card 310 (e.g., the end to be furthest inside a sleeve enclosure). For example the lock/retention feature 522 may be located on carrier card extension 310C. Optionally (not shown) there may be a fold line between carrier card 310 and carrier card extension 310C. The lock/retention feature 522 may be formed by various methods, including injection molding or thermoforming. It may be a separate piece, attached to carrier card 310 or its extension 310C, or it may be integrally formed with carrier card 310 (for example lock/retention feature 522 may be formed along with a thermoformed or injection molded plastic carrier card or blister card). If desired, a portion of the lock/retention feature 522 may be cut away to form a sharp edge to help engage a portion of a sleeve. The lock/retention feature 522 may interact with a sleeve to hold or release structure 503 within the sleeve. Shapes other than shown in FIG. 16 may be used for the lock/retention feature 522. More than one lock/retention feature may be provided. The lock/retention feature may serve as a lock feature (to keep the card entirely inside the sleeve), a retention feature (to keep the card from being completely removed from the sleeve), or as a lock feature and a retention feature.

Other types of lock/retention features may be utilized, for example grommets, rivets, or other mechanical structures attached to and extending away from the carrier card 310 or its extension.

Figure 17:
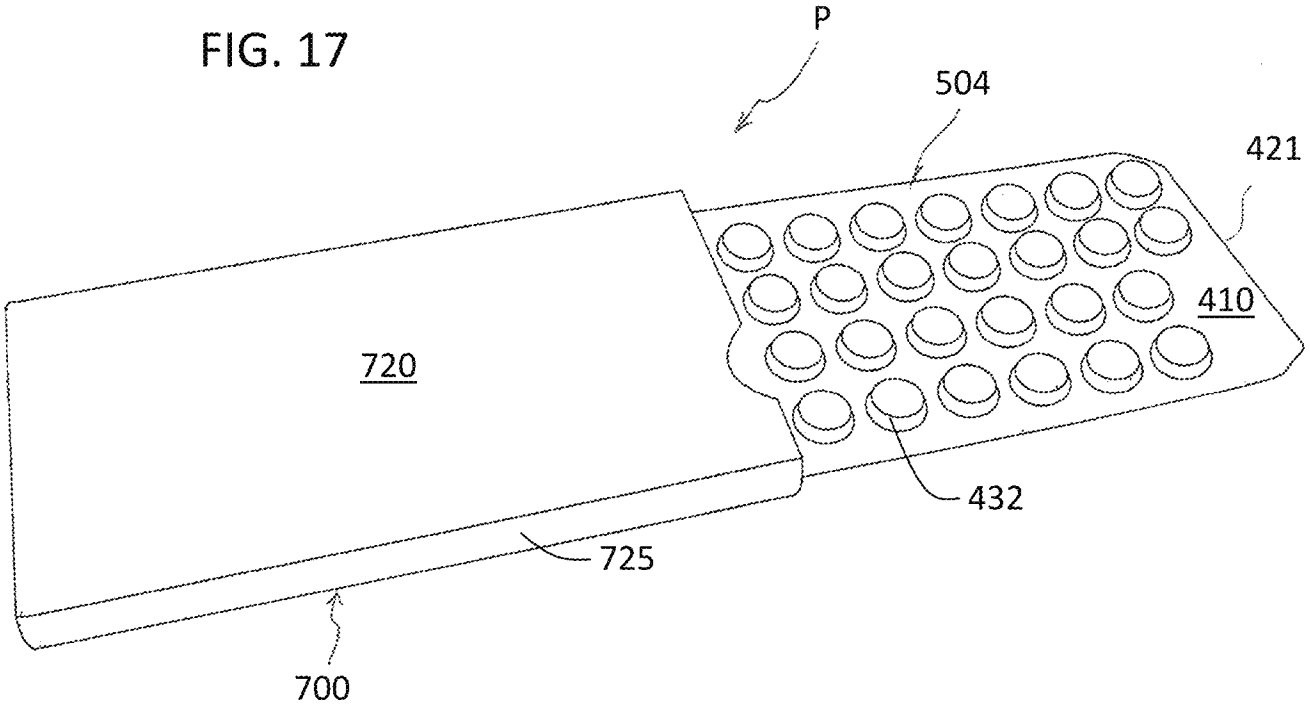

As shown in FIG. 17, the carrier card/blister card combinations described thus far herein may be used with an outer shell or sleeve to form a restricted access package 'P' comprising a lockable receptacle (e.g., a blister strip/carrier) 504 and an outer sleeve 700. The lockable receptacle and outer sleeve have co-operative features which can lock the receptacle within the outer sleeve to thereby allow only restricted access to the package contents. Additionally, the receptacle and outer sleeve of the present invention have co-operative features to enable the receptacle to be unlocked and at least partially withdrawn or slid out from the outer shell so that a user may access the blisters and articles held therein.

In a locked configuration of the package, the receptacle is stowed within the outer sleeve and locked in place by a mechanical complementary locking mechanism such that the articles held in the blister cavity or cavities cannot be accessed. Operation of a release mechanism is required in order to unlock the receptacle from the outer sleeve and to allow its withdrawal from the outer sleeve.

As a further optional aspect of the invention, it is envisaged that in certain embodiments, the lockable receptacle and outer sleeve may have co-operative features to prevent, restrict or otherwise mitigate against the receptacle being completely removed from the outer shell. An unlocked configuration is illustrated in FIG. 17, wherein the blister card/carrier card is disengaged and withdrawn, albeit only to a permitted and limited extent, from the outer sleeve.

The blister card may be a thermoformed plastic sheet (for example PVC) and may have at least one receiving cavity or blister for holding an article. The at least one receiving cavity or blister may be formed as a protrusion of a first (upper) surface and as an indentation of a second (lower) surface, or vice versa. In the illustrated arrangement of FIGS. 17 to 22 the blister card 430 has a main layer 434 in which about twenty-eight blisters or cavities 432 are formed, each for receiving an article (not shown). The blister card 300, that is, the main layer 434, may be lidded or sealed with a lidding sheet 436, such as an aluminum foil sheet, paperboard layer, polymeric film and/or other perforable or peelable material. Whereas perforable films are often used in pharmaceutical push-through packages, where a tablet is pushed out of the blister 432 and this action breaks the lidding film to allow that tablet to exit the blister 432, in other embodiments the lidding film may, for example, be peelable and therefore not necessarily of the push-through type. To provide a peelable lidding film 336, a releasable adhesive may be used to attach the lidding film 336 to the thermoformed sheet (the sheet 334 with the cavities 332). To provide a non-peelable lidding film 336, a non-releasable adhesive may be used to attach the lidding film 336 to the thermoformed sheet 334.

The articles to be accommodated by the blisters 432 may, for example, be tablets, pills capsules or, for example, any other form of medicament, healthcare item, personal item, drug, vitamin, electrical component or other article.

Figure 18:
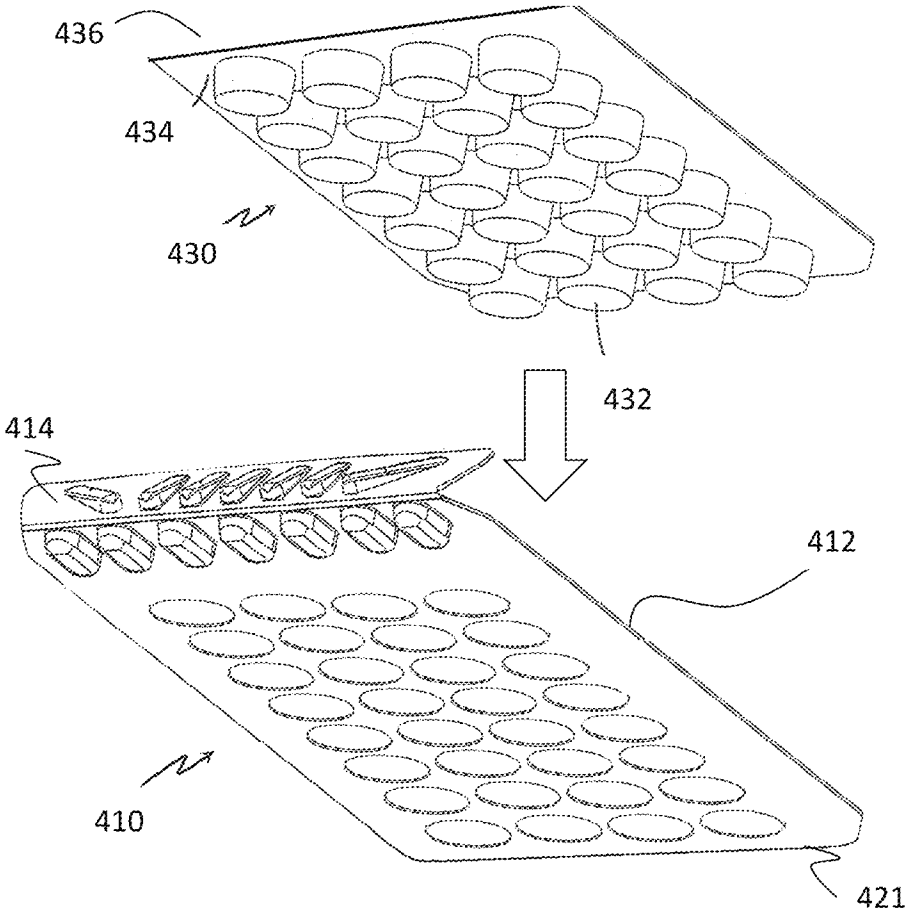
Figure 19:
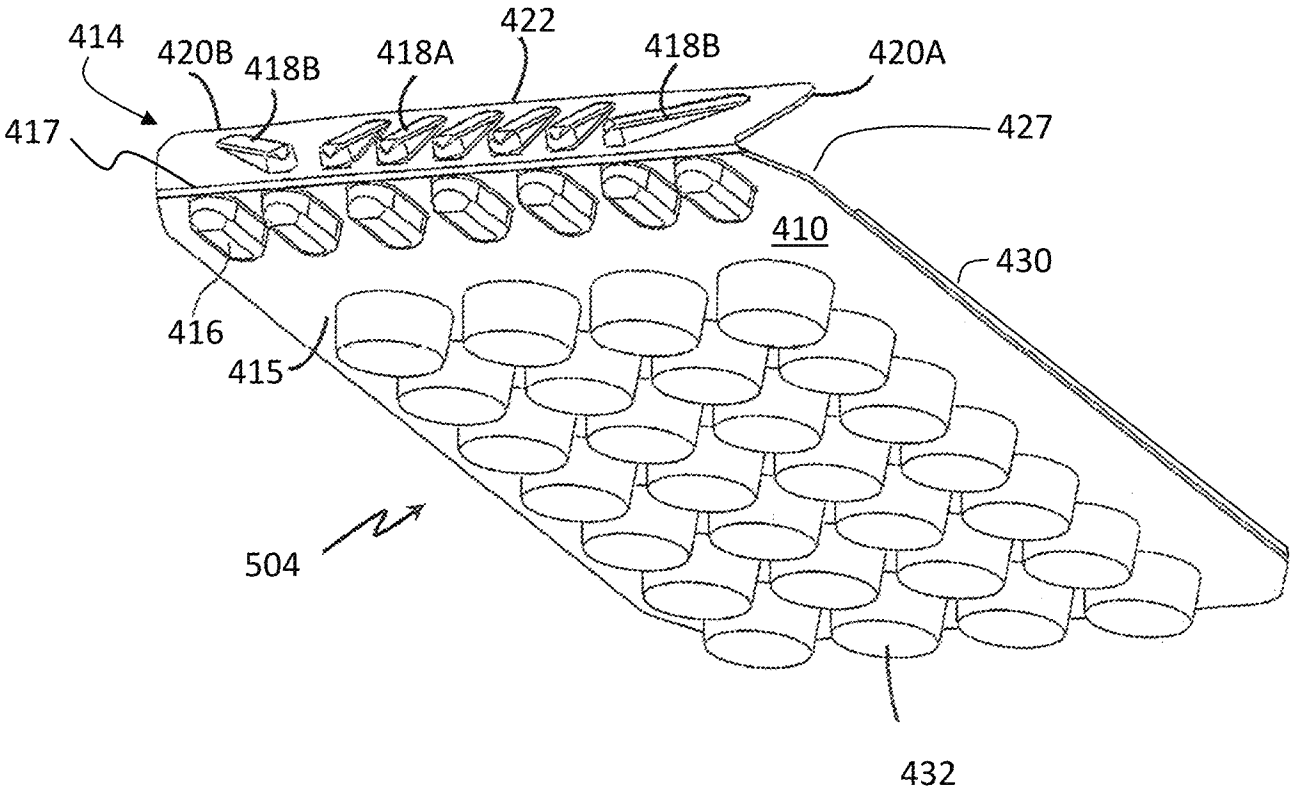

The leading edge 421 of the carrier card 410 is the edge that first exits the outer shell 700 when the card structure 410 is withdrawn from the outer shell 700 (see FIGS. 17-18). A locking tail flap 414 is formed at the opposite end of the card structure 410 and is connected by a hinge 417 (optionally formed as a creased or demarcated or perforated or embossed or debossed or otherwise weakened fold line 417) to a trailing end of the main portion 410 of the carrier card 504 (see FIG. 19). Opposite to the hinge 417 is a free edge 420A/422/420B of the locking tail flap 414. The free edge comprises a medial engaging portion 422. Disposed on either side of the medial engaging portion 422 are wing portions 420A, 420B.

Optionally, the carrier card 504 and locking tail flap 414 may comprise complementarily shaped tapered edge portions 424A, 424B proximate to and terminating on the hinge connection 417. When the locking tail flap 414 is folded relative to the main portion 410, the tapered portions 424A of the locking tail flap 414 are moved closer to the tapered portions 424B of the carrier card 504. As a result of the tapered portions 424A, 424B, the folded blister strip 504 has a narrower width edge defined by hinge connection 417 that becomes the leading edge when the carrier card 504 is being loaded into an outer shell 700. The co-operatively tapered shaped portions 424A, 424B thereby assist with the easy installation of the folded carrier card 504 into an outer shell 700. As such, the locking tail flap 414 has a region (along hinge connection 417) where the width of the locking tail flap 414 may be less than the maximum end-to-end width between the side edges of the locking tail flap 414. Optionally, the side edges each include at least a straight portion. Alternatively, the maximum end-to-end width of the locking tail flap 414 is equal to, or greater than, the maximum end-to-end width of the main portion 410 of the carrier card 504.

Optionally, one or more integral formations 418A, 418B, each formed as a protrusion of the second surface 415 and as an indentation of the first surface 427 are provided on the locking tail flap 414. The one or more integral formations each have a non-uniform height. The one or more integral formations, which may also be referred to as embossments or false blisters 418A, 418B herein, are provided on or integrally formed within the locking tail flap 414. The one or more false blisters 418A, 418B are configured such that they can each provide a degree of reinforcement or rigidity to the locking tail flap 414 to help prevent bowing of the tail flap and at the same time fit within the outer shell 700 when the locking tail flap 414 is disposed in its locking position. The integral formations 418A, 418B may extend generally away from hinge connection 417. The furthest extension of the integral formations 418A, 418B from the fold line may be no greater than about 2.5 mm and optionally no greater than about 1 mm. Likewise false blisters 416 may extend generally away from hinge connection 417. The furthest extension of the false blisters 416 from the fold line may be no greater than about 2.5 mm, and optionally no greater than about 1 mm.

In use, the locking tail flap 414 is folded about hinge connection 417 toward the first surface 427 of the main portion 410 of the carrier card 504 and away from the false blisters 416. This folded configuration results in the false blisters 418A, 418B projecting above the locking tail flap 414 and between the upper composite wall 730/740/710 of the sleeve 700 and the locking tail flap 414. This is best illustrated in FIG. 10, which shows the locked configuration of the package 'P'. In an alternative embodiment, however, the locking tail flap 414 may be folded about hinge connection 417 toward the false blisters 416 and toward surface 415 of the main portion 410 opposite to surface 427 where the blister card 430 is placed. This folded configuration would result in the false blisters 418A, 418B projecting from the locking tail flap 414 toward the false blisters 416 and located between the locking tail flap 414 and the false blisters 416. In such an embodiment, the false blisters 418A, 418B tend to be brought into direct contact with the false blisters 416 as the locking tail flap 414 is folded, and thereby function as a spacer or even added spring between the locking tail flap 414 and the main portion 410. As a result, the blisters 418A, 418B, 416 prevent the locking tail flap 414 from being folded 180 degrees or all the way to the non-backing side of the main portion 410. Such an arrangement would be useful to reduce the chance of unintentional disengagement of the locking tail flap 414 from a recess 'R' of the outer shell 700—the recess 'R' will be discussed in more detail later.

The false blisters 418A, 418B, 416 are optionally press-formed or molded out of the locking tail flap 414 and main portion 410. Optionally, the false blisters 418A, 418B, 416 may be integrally formed with the locking tail flap 414 or affixed thereto. Where the false blisters 418A, 418 are integrally molded out of the locking tail flap 414 the first surface 427 of the locking tail flap 414 may have indentations corresponding to the impression of the false blisters 418A, 418B.

The false blisters 418A may be disposed in series of one or more, and optionally five, substantially parallel false blisters 418A. These false blisters 418A may provide a degree of rigidity to the locking tail flap 414, and may assist in the appropriate or desired bending or flexing of the locking tail flap 414 when the locking tail flap 414 is engaged with the outer shell 700, and/or deflected to cause unlocking of the locking tail flap 414 from the outer shell 700. Optionally, one or more obliquely angled false blisters 418B may be provided on the wing portions 420A, 420B of the locking tail flap 414 and beneficially provide rigidity to the corner wing portions 420A, 420B which may improve the strength of the brace provided by the "full-width" locking tail flap 414. Optionally, the obliquely angled false blisters 418B may be directed towards the corners of the locking tail flap and optionally may reinforce, strengthen or otherwise enhance the rigidity of the corners of the locking tail flap 414. In the illustrated configuration, two obliquely angled false blisters 418B are provided on the locking tail flap 414, each directed from proximate the hinge connection 417 and towards each corner of the locking tail flap 414. At least one false blister is optionally pressed or molded out of the locking tail flap 414. The number, size, and configuration of the false blisters 418A, 418B provided on the locking tail flap 414 may be varied from that illustrated. It should be readily understood that the closer the false blisters 418*a*, 418*b* on the locking tail flap 414 are to the false blisters 416, the greater the structural strength of the locking tail flap 414. The greater the structural strength of the locking tail flap 414, the more reliable the engagement of the locking tail flap 414 with the sleeve 700. The false blisters 418*a*, 418*b* may be extended all the way to the free/engaging edge of the locking tail flap; however, the arrangement wherein the false blisters 418*a*, 418*b* stop in short of the engaging edge of the locking tail flap and thereby a flat, no blister area is left between the engaging edge and the false blisters may interact better with the outer shell for the purpose of providing reliable engagement of the locking tail flap and the sleeve.

Figure 22:
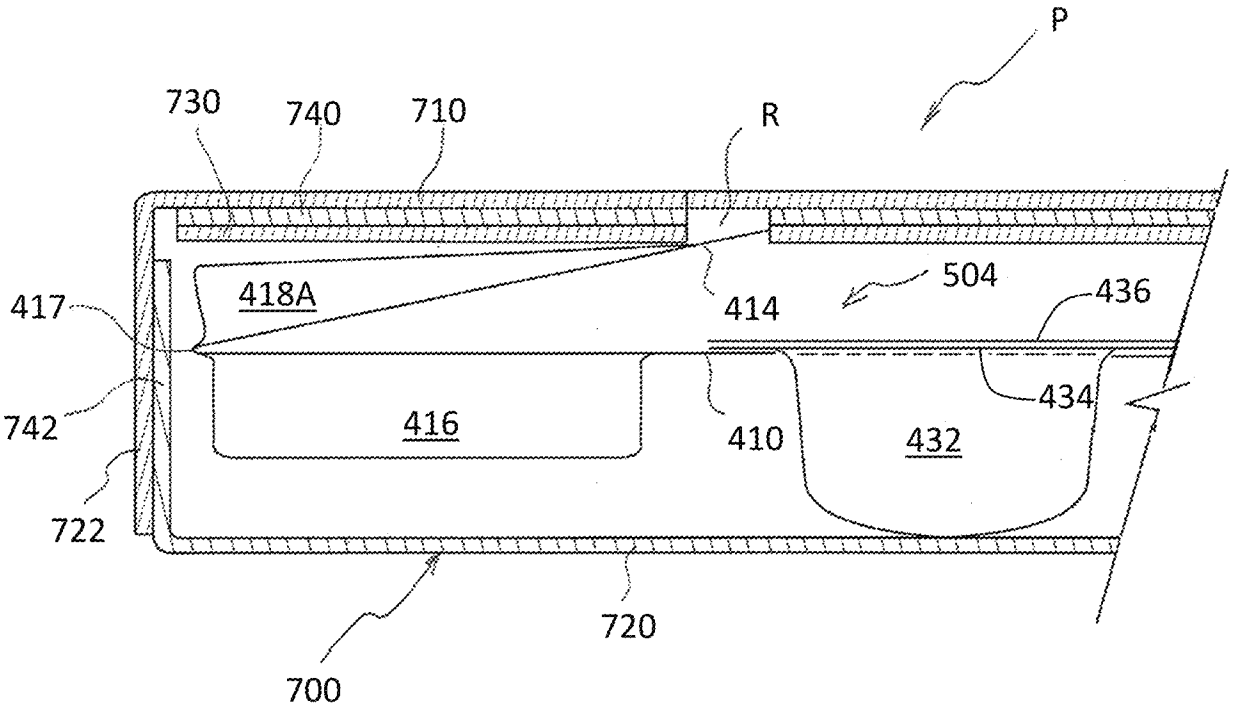

In the present arrangement, the carrier card 504 is arranged such that the locking tail flap 414 folds about hinge 417 and towards the first surface 427 of the main portion 412 of the carrier card 504. As a result of the locking tail flap 414 being folded relative to the main portion 410 of the carrier card 504 in this way (rather than the second surface 415 of the locking tail flap 414 being folded towards the second surface 415 of the main portion 410 of the carrier card 504), the surface of the locking tail flap 414 that is closest to the internal locking aperture 739/749 (described below) of the outer shell or sleeve 700, is the second surface 415, from which the false blisters or reinforcing ribs 418A, 418B project upwardly. The locked position of the carrier card 504 within the sleeve 700 is shown in FIG. 22, wherein the location of the false blisters or reinforcing ribs 418A, 418B is shown.

The sleeve 700 as shown is optional and exemplary and is capable of receiving the carrier card 504 for forming a package 'P' (see FIG. 17). The sleeve 700 may be formed from a variety of materials, for example, plastics material, paperboard material and/or combinations of these and other materials. Optionally, and as illustrated, the sleeve 700 may be formed from foldable sheet material, for example paperboard.

Figure 20:
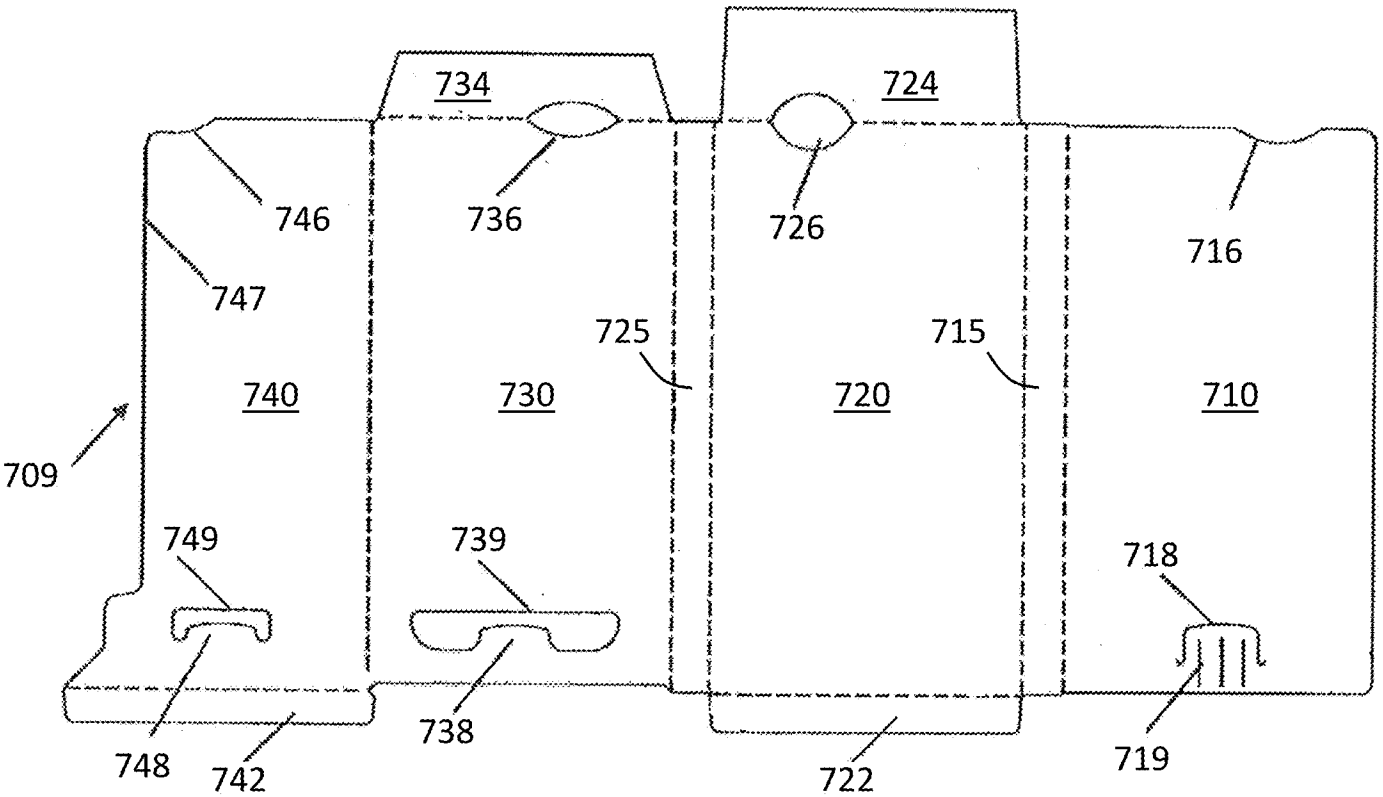

In FIG. 20, an exemplary embodiment of a blank 709 is illustrated. The blank 709 is for forming the exemplary outer shell or sleeve 700 for use with an exemplary carrier card 504.

As illustrated, the outer shell or sleeve 700 forms a generally tubular structure with a generally rectangular cross section. Blank 709 has a series of foldably attached panels including: a front panel 710, first side panel 715, back panel 720, second side panel 725, first auxiliary panel 730, and second auxiliary panel 740.

Front panel 710 may include a release button in the form of an area denoted by a cut line 718 which may be generally U-shaped. The release button may have score lines, ribs, crease lines or other formations 719 to provide stiffness to the release button. A cut-away portion 716 may be provided which may coincide with other cut-away portions 726, 736 in the finished sleeve 700.

Back panel 720 at a "closed" end may be hingedly attached to a first or outer end closure flap 722. Back panel 720 at its opposite "open" end may be provided with an inward facing flap 724 that may be useful for retaining contents within the sleeve (for example, by its natural resilience causing the folded inward facing flap 724 to be urged towards its unfolded position, in which it releasably closes the "open" end of the outer shell 700). A cutaway 726 may be provided, which may coincide with other cutaways 716, 736 in the finished sleeve 700.

The first auxiliary panel 730, which becomes an innermost ply of a composite front wall 710/740/730, comprises an aperture 739 shaped to engage at least part of the locking tail flap 14 of the blister strip 10. Release tongue 738 may extend into the aperture 739 to act along with release button 718 and a release tongue 748 in releasing the engaged part of the locking tail flap 14. At the other end of the first auxiliary panel 730 an inward facing flap 734 may be provided. The inward facing flap 734 may be useful for retaining contents within the sleeve 700, optionally by engagement of the locking tail flap 14 against an edge of that inward facing flap 734. A cutaway 736 may be provided, which may coincide with other cutaways 716, 726 in the finished sleeve 700.

The second auxiliary panel 740, which becomes an intermediate-ply of the composite front wall 710/740/730, comprises an aperture 749 shaped in correspondence with, and positioned in alignment with, aperture 739. The aperture 749 is also arranged to engage at least part of the locking tail flap 14 of the blister strip 10. Release tongue 748 may extend into the aperture 749 to act along with release button 718 and release tongue 738 in releasing the engaged part of the locking tail flap 14. For example the release button 718, release tongue 738, and release tongue 748 may all deflect inward when a user applies inward pressure to the release button 718. Second auxiliary panel 740 at the "closed" end may be hingedly attached to a second or inner end closure flap 742. At the opposite "open" end, cutaway 746 may be provided which may coincide with other cutaways in the finished sleeve 700. The free side edge 747 of the second auxiliary panel 740 may be shaped such that the second auxiliary panel 740 is not of a uniform width and is partially cut away.

The blank shown in FIG. 20 may be folded with the second auxiliary panel 740 folded backwards and behind the first auxiliary panel 730. The auxiliary panels 730, 740 may be attached together, for example by glue or hot melt glue. The release tongues 738, 748 generally overlap in this configuration.

The inward facing flaps 724, 734 may now be folded inwardly upon back panel 720 and first auxiliary panel 730, respectively. These flaps 724, 734 may be held in place by the creased fold, and/or may be glued against their respective panels, or heat sealed thereto. Optionally, inward facing flap 734 is adhered to the first auxiliary panel 730 and inward facing flap 724 is not affixed to the back panel 720.

The part-formed structure may then be further folded, with the auxiliary panels 730, 740 folded forward and over back panel 720. This results in a configuration where the back panel 720, second side panel 725, and auxiliary panels 730, 740 make up three walls of a tubular structure. (It should be noted that the use of tear resistant materials, and/or more than one layer, helps to improve the tamper- and theft-resistance of the package.) To finish assembling the sleeve 700, the inner closure flap 742 is first folded downward. The outer closure flap 722 may then be folded upward into facing contact with the inner closure flap 742. The facing surfaces of the outer closure flap 722 and inner closure flap 742 are optionally both heat seal coated, so that a very strong seal may be created and a composite end closure wall formed at the "closed" end of sleeve 700.

After the front panel 710 has been folded up and over secondary auxiliary panel 740, these two panels 710, 740 may be affixed together, for example by heat sealing, to form the finished sleeve 700 as shown in FIG. 17.

Cutaway 747 in second auxiliary panel 740 allows a portion of the inner surface of front panel 710 (a surface optionally having a heat seal coating) to seal to a portion of the surface of the first auxiliary panel 730 (a surface that may not have the heat seal coating).

As the front panel 710 is secured to both auxiliary panels 730, 740, a composite front wall is formed which has, at least in parts, three plies of material. This creates a stiff composite front wall which may help prevent bowing and enables a recess 'R' to be formed (see FIG. 10).

The outer shell or sleeve 700 is configured to receive the carrier card 504 or another suitable inner card structure. As such the composite top wall 710/740/730 and bottom wall 720 of the outer shell 700 are spaced apart and are shaped and dimensioned to create a cavity or inner housing, into which carrier card structure 504 can be placed. The carrier card 504 is optionally slidably and reasonably tightly placed into the housing provided by the outer shell 700 and in such a manner that the co-operative mechanical lock between the locking tail flap 414 and engaging apertures 739/749 is able to operate.

In FIG. 22, an illustration is provided of a side-view of a cut-away portion of the sleeve 700. This shows how the locking tail flap 414 of the folded carrier card 504 fits securely within sleeve 700 and how at least part of an engaging portion (also referred to as 'engaging edge') 422 of the locking tail flap 414 is disposed within a recess 'R' formed within the three-plies of material of the composite front wall 710/740/730 by the apertures 749 and 739 respectively. The locking tail flap 414 has a degree of natural resilience and after being folded about hinge 417, is biased to return to its unfolded state. This degree of resilience causes at least part of the engaging portion (leading edge) 422 of the locking tail flap 414 to position itself within the recess 'R' and optionally abut edges of the apertures 739 and/or 749 respectively.

Figure 21:
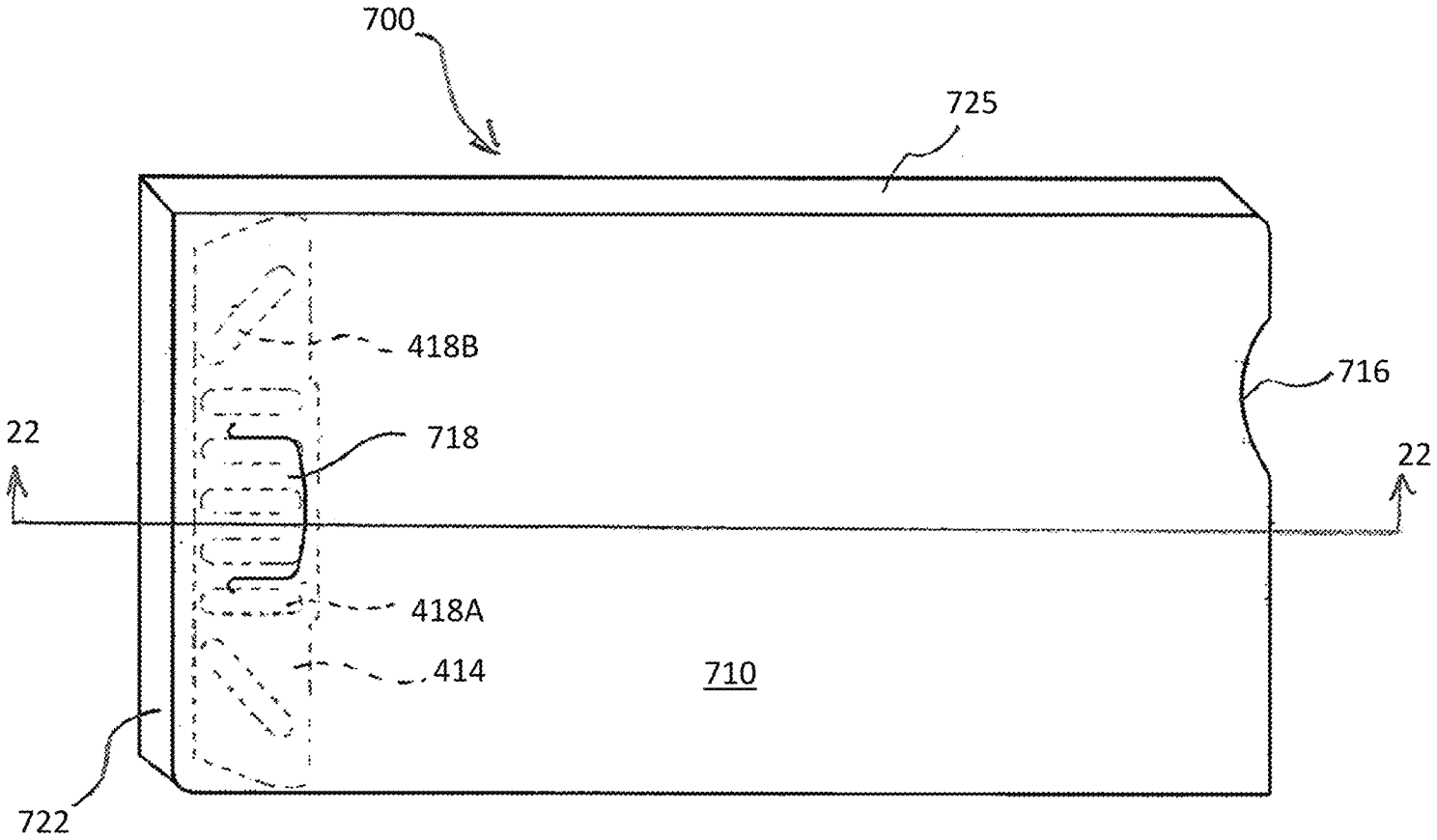

The internal height of the sleeve 700 between the composite front wall 710/740/730 is variable across the sleeve 700 in the region of the locking apertures 749, 739. To illustrate this, FIG. 21 shows an illustration of sleeve 700 with a ghost outline of the general location of the locking tail flap 414 in its locked state. Longitudinal reference line 22-22 is also depicted which refers to the cross sectional view seen in FIG. 22. Along the line 22-22, the engaging portion 422 of the locking tail flap 414 is disposed within the recess 'R' and is disposed immediately beneath the front panel 710 of the composite front wall 710/740/730. As noted before, this is depicted in FIG. 22, which shows a partial cut-away end view of the sleeve 700 and folded carrier card 504 taken generally along the line 22-22.

It will be understood, therefore, that the locking tail flap 414 is not flat or planar in its locked state. The addition of the wing portions 420A, 420B and larger structured locking tail flap 414 give rise to a stronger locking mechanism that may provide a greater degree of child resistance.

Each of the false blisters 418A, 418B provides a degree of rigidity to the locking tail flap 414 and at the same time allows for the unfettered engagement of the locking tail flap 414 and outer shell 700. To facilitate this it is preferred, but is nevertheless optional, that the false blisters 418A, 418B are tapered or wedge-shaped or angled towards the furthermost end corners of locking tail flap 414. The angle of false blisters 418B with respect to the fold line 417, optionally, is approximately 45 degrees.

It can be appreciated that various changes may be made within the scope of the present invention. F or example, the size and shape of the outer shell or sleeve, blister card, carrier card, the panels for forming the paperboard outer sleeve and the full width locking tail flaps may be adjusted to accommodate differing size and/or shape requirements. The size, shape, number and configuration of the false blisters formed on the locking tail flap 414 may be altered from that illustrated.

Whereas the illustrated embodiment comprises blisters 432 placed within carrier card 504, it is envisaged that in other embodiments the article receiving blister 432 may be replaced with an article receiving area to which one or more articles is affixed, for example by means of adhesive and/or wrapping film. The blisters 432 may be differently shaped and positioned than shown in the examples.

It will be recognized that the locking tail flap 414 may have no tapered edge portions 424A but have a uniform width all the way along its length, according to the present invention. Such an arrangement may increase the structural strength of the respective locking tail flap.

It will be recognized that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The carrier card and/or blister card may have extension panels that may be folded over the structure, for example to provide room for additional blisters.

The carrier card may be made of a sheet material such as paperboard or tear-resistant paperboard such as MeadWestvaco NATRALOCK®. The carrier card may also be made of plastic or other sheet materials.

The blister or blisters may be made with common thermoform plastics such as PVC (polyvinyl chloride) or APET (amorphous polyethylene terephthalate) but may also include a recycled material such as RPET (recycled polyethylene terephthalate) or a biodegradable material such as PLA (polylactic acid). However other materials including other plastics or paperboard also may be used.

The sealing or lidding film may be made from various materials including aluminum foil, aluminized or metalized plastic films, plastic films, and the like.

The blister card(s) may be attached to the carrier card adhesively. The blister card(s) may be attached to the carrier card by heat sealing, RF (radio frequency) sealing, ultrasonic sealing, adhesive film, adhesive tape, double-faced adhesive film, double-faced adhesive tape, liquid adhesives, or any other form of adhesive attachment. Heat sealing may be accomplished by use of both heat and pressure. Mechanical methods may also be used to attach the blister card to the carrier card, including without limitation stapling, stitching, grommets, snaps, hooks, rivets, clips, crimping, folding, and any suitable mechanical fasteners. If the blister card and carrier card are both plastic, they may be welded together by methods of welding plastic materials.

The packages disclosed herein may be made from one or several blanks (for example, the carrier card and/or blister sheet may be made from one or more pieces.

Where more than one blank is used, the blanks may be assembled in various stages, including assembling a unitary blank into a package, assembling separate blanks and then joining them to form a package, and joining two or more blanks together, for example by heat sealing, gluing, mechanical fastening, or otherwise and then forming the combined blanks into the package.

It is to be understood that certain packages may be one continuous piece of material, and other packages may comprise two or more pieces of material. It is to be understood that a package may be heat sealed even where a heat sealed surface is in contact with a non-heat sealable surface. It is to be understood that in such a situation such an adhesion will strengthen the package, though it may not strengthen it as much as heat sealing between two heat sealable surfaces.

The packages described herein may be assembled in stages at various locations, for example partially constructing the package, moving or shipping it to one or more other locations, and completing the assembly of the package. For example, a package may be formed into a flattened or collapsible structure, then moved or shipped to another location for final forming, filling, and closure.

Portions of the packages may be made of one, two, or more layers of material. It is to be understood that additional layers of material may be used based on manufacturing preferences. Portions of certain cards may be folded over or around the portions of other cards, creating multiple layers of material.

The invention claimed is:

1. A packaging structure for lockable placement into an outer sleeve, the packaging structure comprising a blister card and a carrier card combined together to form a single unit, the blister card comprising:

a polymeric sheet having first and second opposing surfaces;

at least one cavity formed in the polymeric sheet as at least one depression in the first surface and extending as at least one protrusion from the second surface; and a lidding sheet mounted on the first surface and sealing the at least one cavity;

the carrier card comprising:

a carrier sheet having at least one aperture in which the at least one protrusion is received; and a retention device associated with the carrier sheet to lockably engage with an outer sleeve, wherein the carrier sheet is attached to the second surface of the polymeric sheet in a face-to-face contacting arrangement such that the lidding sheet remains uncovered by the carrier sheet.

2. The packaging structure of claim 1, wherein the polymeric sheet is adhesively attached to the carrier sheet.

3. The packaging structure of claim 2, wherein the lidding sheet is attached to the first surface by releasable adhesive.

4. The packaging structure of claim 2, wherein the polymeric sheet is attached to the carrier sheet by a double-faced adhesive film or tape.

5. The packaging structure of claim 2, wherein the polymeric sheet is attached to the carrier sheet by heat sealing.

6. The packaging structure of claim 1, wherein the polymeric sheet is attached to the carrier sheet by welding.

7. The packaging structure of claim 1, wherein the retention device comprises a locking flap hingedly connected to the carrier sheet, and the locking flap is folded backward over one of the first and second surfaces of the carrier sheet.

8. The packaging structure of claim 1, wherein the retention device is an opening formed in the carrier sheet.

9. The packaging structure of claim 1, further comprising a carrier sheet extension attached to the carrier sheet along a fold line and folded at an angle to the carrier sheet, and a node extending from the carrier sheet extension.

10. The packaging structure of claim 1, wherein the carrier sheet is formed from a plastic material and the retention device comprises a projection formed on one of the first and second surfaces of the sheet.

11. The packaging structure of claim 1, further comprising an outer sleeve with at least one mechanical feature to releasably engage the retention device.

12. The packaging structure of claim 1, wherein the carrier card is formed from plastic.

13. The packaging structure of claim 12, wherein the retention device comprises a locking flap hingedly connected to the carrier sheet along a fold line, the locking flap having at least one embossment, the fold line being an integral formation of the carrier card.

14. The packaging structure of claim 13, wherein the fold line is co-formed simultaneously with the formation of the at least one embossment.

15. The packaging structure of to claim 13, wherein the at least one first embossment extends substantially from the fold line.

16. The packaging structure of claim 15, wherein the at least one first embossment terminates at a point at a first distance from the fold line, the first distance being no greater than 2.5 mm.

17. The packaging structure of claim 16, wherein the at least one second embossment extends substantially from the fold line.

18. The packaging structure of claim 17, wherein the at least one second embossment is co-formed simultaneously with the fold line and the at least one first embossment.

19. The packaging structure of claim 1, wherein the lidding sheet has an inner surface and an outer surface, with the inner surface contacting the first surface, and the outer surface is not adhered to any other part of the blister card.

20. A packaging structure for lockable placement into an outer sleeve, the packaging structure comprising a blister card and a carrier card combined together to form a single unit, the blister card comprising:

a polymeric sheet having first and second opposing surfaces;

at least one cavity formed in the polymeric sheet as at least one depression in the first surface and extending as at least one protrusion from the second surface; and a lidding sheet mounted on the first surface and sealing the at least one cavity;

the carrier card comprising:

a paperboard carrier sheet having at least one aperture in which the at least one protrusion is received; and a retention device associated with the carrier sheet to lockably engage with an outer sleeve, wherein the paperboard carrier sheet is attached to the second surface of the polymeric sheet in a face-to-face contacting arrangement such that the lidding sheet remains uncovered by the carrier sheet, and wherein the lidding sheet has an inner surface and an outer surface, with the inner surface contacting the first surface, and wherein no paperboard is directly adhered to the lidding sheet outer surface and no paperboard is directly adhered to the second surface of the polymeric sheet.

* * * * *